US005757334A

United States Patent [19]

Cobb

[11] Patent Number: 5,757,334

[45] Date of Patent: May 26, 1998

[54] GRAPHITE COMPOSITE STRUCTURES EXHIBITING ELECTRICAL CONDUCTIVITY

[75] Inventor: Jack M. Cobb, San Juan Capistrano, Calif.

[73] Assignee: Hughes Electronics Corporation, El Segundo, Calif.

[21] Appl. No.: 572,931

[22] Filed: Dec. 15, 1995

Related U.S. Application Data

[63] Continuation of Ser. No. 258,122, Jun. 10, 1994, Pat. No. 5,554,997, which is a continuation of Ser. No. 9,137, Jan. 17, 1992, abandoned, which is a continuation of Ser. No. 400,187, Aug. 29, 1989, abandoned.

[51] Int. Cl.[6] ..... H01Q 9/16; H01Q 9/22; H01B 7/34; H01B 1/00

[52] U.S. Cl. ..... 343/873; 343/897; 343/900; 343/906; 174/102 R; 174/102 SC

[58] Field of Search ..... 343/715, 825, 343/841, 873, 897, 900, 906; 451/75, 78; 174/102 R, 102 SC, 106 SC; 252/502, 513, 514; 428/367

[56] References Cited

U.S. PATENT DOCUMENTS

| | | | |
|---|---|---|---|
| 3,811,919 | 5/1974 | Lescop et al. | 117/62 |
| 4,134,120 | 1/1979 | DeLoach et al. | 343/715 |
| 4,661,403 | 4/1987 | Morin | 428/367 |
| 4,680,610 | 7/1987 | Pammer | 357/68 |

*Primary Examiner*—Peter Toby Brown

*Attorney, Agent, or Firm*—G. S. Grunebach; M. W. Sales; W. K. Denson-Low

[57] ABSTRACT

Continuous, elongated nickel plated graphite fibers are bound with an epoxy and are formed into a structural shape (11). An area (13) of the epoxy is removed by bead blasting to expose a layer of the plated graphite fibers (14), which are aligned in the desired direction of radio frequency current propagation. The bead blasted area (13) is then silver plated to obtain good contact to the plated graphite fibers (14) and resultant high conductivity from the structural shape (11).

16 Claims, 4 Drawing Sheets

GRAPHITE COMPOSITE STRUCTURES EXHIBITING ELECTRICAL CONDUCTIVITY

This application is a continuation of application Ser. No. 08/258,122, filed Jun. 10, 1994, now U.S. Pat. No. 5,554,997, for which priority is claimed; which is a continuation of application Ser. No. 08/009,137, filed Jan. 17, 1992, now abandoned, for which priority is claimed; which is a continuation of application Ser. No. 07/400,187, filed Aug. 29, 1989, now abandoned, for which priority is claimed.

BACKGROUND OF THE INVENTION

1. Field of the Invention

The subject invention relates to electrically conductive composite materials and, more particularly, to graphite epoxy composite materials formed into conductive structures.

It has long been recognized that graphite is at least a semiconductor of DC and RF energy. However, the only heretofore practical application of this characteristic has been the use of chopped fibers in an epoxy matrix for RFI shielding and as an RF reflector surface, i.e., parabolic reflectors.

2. Description of Related Art

A main design consideration for almost every structure, and especially airborne and spaceborne structures, is weight. The designer needs materials having a certain strength, while at the same time having as little weight as possible. Increasingly, designers seek to combine multiple functions in a single structure. For example, a structure which provides a necessary antenna configuration, while being at the same time electrically conductive, provides required mechanical and electrical functions in a single structure. A further requirement is that such structure be as lightweight as possible.

As an example, in the case of a dipole antenna to be carried aboard a spacecraft, the antenna must be as lightweight as possible, in one case not exceeding 0.5 lb. Such structures must, for example, be able towithstand harsh mechanical vibrations associated with satellite launch environments. Such requirements imply a high stiffness-to-weight ratio. While aluminum and steel can probably meet strength and electrical conductivity requirements, they, in many cases, are far too heavy to meet mission weight limitations.

As another example, aircraft wings may, in addition to providing the necessary airfoil for lift purposes, house radio or radar antennas, and wing heaters for deicing purposes. While typically these three functions are provided by different materials which are interconnected in some manner, the mere use of three different materials results in a certain weight accumulation. It would be an advance in the art if all three functions could be provided by a single material, and if such material were more lightweight than prior techniques. Once again, a high stiffness-to-weight ratio would be required to meet the stresses placed on an aircraft wing.

Some investigation into the use of conducting plastics has been performed. However, such presently-known materials suffer from severe disadvantages, such as poor strength when highly conductive, or poor conductivity when strength is increased. Many are not stable under extreme temperature ranges, some degrade relatively rapidly in the presence of water, and most, if not all, do not possess sufficient electrical conductivity for many applications.

It would be an advance in the art to provide a material having a high stiffness-to-weight ratio, having relatively high electrical conductivity, and having relatively low weight.

SUMMARY OF THE INVENTION

It is therefore an object of the invention to improve electrical conducting devices;

It is another object of the invention to provide an electrical conducting structure of reduced weight;

It is another object of the invention to provide a material having relatively high electrical conductivity, relatively low weight, and a relatively high stiffness-to-weight ratio; and It is another object of the invention to provide a strong, lightweight antenna structure for space-based applications.

According to the invention, a structure is formed of a composite material comprising elongated fibers including graphite and a binder such as epoxy. By establishing sufficient electrical contact to the fibers, the structure is rendered a good conductor. To establish contact, the binder material is removed from about the fibers in a selected area, leaving the fibers exposed. Conductive material is then applied so as to make electrical contact with the exposed fibers.

In the foregoing procedure, the wrap angle of the fibers may be selected to achieve a desired electrical conductivity. In a preferred embodiment, nickel plated graphite fibers may advantageously be employed with silver being used to make electrical contact to the exposed nickel plated graphite fibers in the selected areas in which the binder material is removed.

The use of graphite fibers bound with an epoxy material results in a structure exhibiting a high stiffness-to-weight ratio and much less weight than aluminum or steel. The resulting conductive structure may be used to configure an antenna, coaxial transmission line, or other conducting devices, as hereafter described in more detail.

DESCRIPTION OF THE PREFERRED EMBODIMENTS

Figures 1A, 1B:
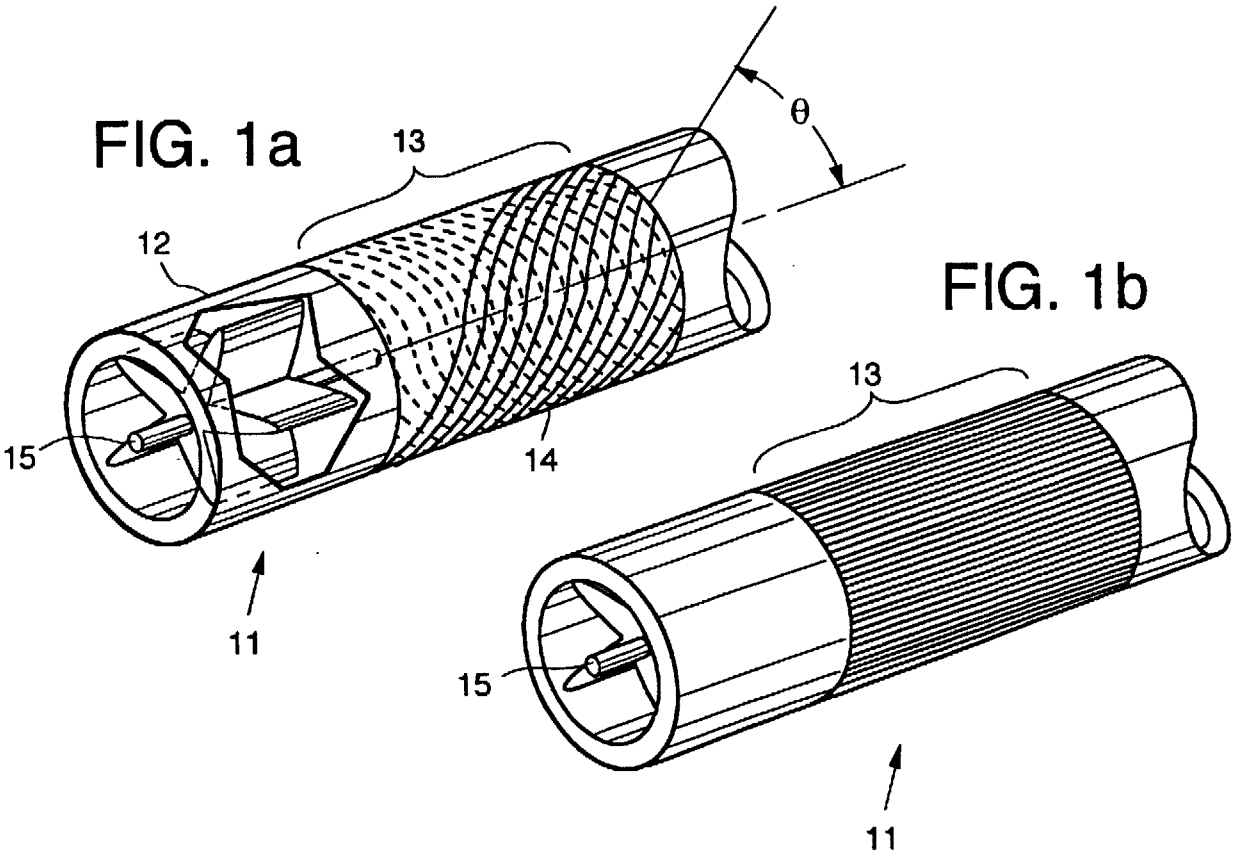
FIGS. 1*a* and 1*b* show perspective views of a graphite composite material in accordance with the invention formed into coaxial conductors according to the preferred embodiment.

FIG. 1*a* illustrates a coaxial conductor 11 fabricated of graphite/epoxy material. In one embodiment of the invention, long, parallel, graphite fibers are bound in an epoxy matrix. The unidirectionally oriented fibers in the matrix may vary in length from, e.g., one to five inches, and contact each other to form a continuous conductive matrix.

Carbon (graphite) fibers are made by pyrolysis of organic precursor fibers in an inert atmosphere. Pyrolysis temperatures generally range from 1000° C. to 3000° C. Currently three precursor materials, rayon, polyacrylonitrile, and pitch (from coal tar products), are the most widely used raw materials in the manufacture of carbon (graphite) fibers. Physical properties such as Young's Modulus, ultimate strength, elongation to failure, and electrical conductivity are determined by processing techniques, i.e., fiber tension and pyrolitic temperatures. Bundles consisting of 1,000 to 150,000 continuous fibers may be formed of straight (tow) or twisted (roving) fibers to suit subsequent manufacturing processes, i.e., unidirectional tape for hand layup or filament winding, respectively.

While graphite has been found to be a relatively strong material, it will buckle under compressive loads. The addition of an epoxy binder contributes strength to the composite so that compressive loads may be handled without compressive instability. It has been found that a composite having 60–65% graphite by weight works well in the application to be described below in detail.

Graphite fibers may also be nickel plated and are commercially available in that form, as described below. Typically, a loose roving or tow is nickel plated with, e.g., one-half Angstrom of nickel and then spun tight. Thereafter, the tightened roving or tow (whether nickel plated or not) may be impregnated with epoxy resin and placed on a spool or a support backing to form a tape. The tape or spool is frozen to prevent premature curing of the epoxy. The tape or spool may be thawed out, wrapped on a mandrel as hereafter described in more detail, and then cured at 250° to 350° F. in an oven to establish a desired shape.

In the preferred embodiment, graphite fibers are used because of their relatively low weight, their electrical conductivity properties, and their relatively high strength. Due to the problem with compressive loads, they are bound together in a nonelectrically conductive material such as a resin. Epoxy was discussed above, but if in a particular application, melting temperature were not a concern, a thermoplastic binder may be selected rather than epoxy.

A material which may be used for the graphite/epoxy composite according to the preferred embodiment is nickel plated Hercules AS4 graphite/epoxy material available from American Cyanamid and having a part number of 985NCGT3290. This material employs continuous graphite fibers of 8-micron diameter which have been nickel plated as described above and which are bound together with an epoxy. The material is in the form of tape with the graphite fibers oriented longitudinally on the tape.

The graphite/epoxy composite may be formed into the outer conductor 12 by wrapping the composite in its thawed, flexible, room temperature state around a mandrel and applying suitable pressure to squeeze out air and any excess epoxy. It has been found that the lowest loss is achieved when the wrap-angle θ at which the graphite fibers are wound is such that the graphite fibers 14 are aligned in the direction of radio frequency current propagation. The center conductor 15 is from a 0.325-inch (0.825 cm) coaxial line, and is held in place at the longitudinal centerline of the outer conductor 12 by means of five dielectric splines.

Figure 2:
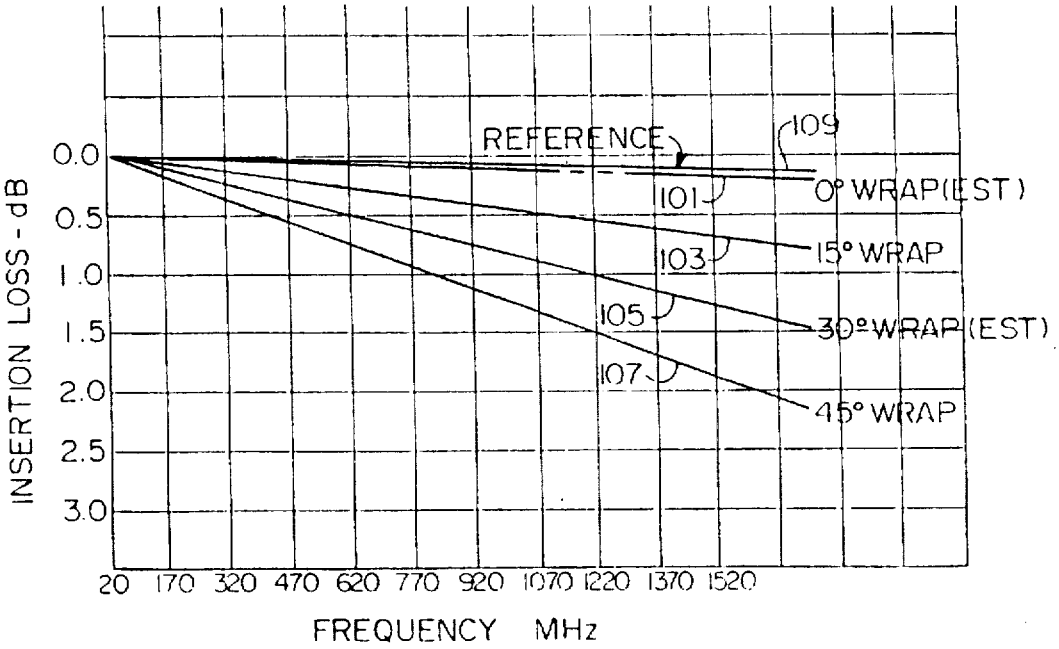
FIG. 2 is a graph illustrating the variation of conductivity over a certain frequency band with the wrap angle of graphite fibers in a graphite/epoxy composite in accordance with the invention.

FIG. 1*a* presents a wrap-angle θ of approximately 15 degrees, while FIG. 1*b* presents a wrap-angle θ of 0 degrees. As is seen, wrap angle in these figures has been measured from the longitudinal dimension of the outer conductor 12. This wrap-angle effect phenomenon is illustrated in FIG. 2, which graphs insertion loss in dB versus frequency in MHz for various wrap angles of a 28-inch (71.12 cm) length of five spline, 0.325-inch (0.827 cm), nickel plated AS4 graphite/epoxy conductor coaxial cable with TNC connectors and copper inner conductor. In the graph of FIG. 2, lines 101, 103, 105, 107 represent wrap angles of 0 degrees, 15 degrees, 30 degrees and 45 degrees, respectively. These wrap angles are referenced to the insertion loss of a 0.325-inch (0.827 cm) diameter, five spline, standard copper coaxial cable represented by line 109.

Figure 3:
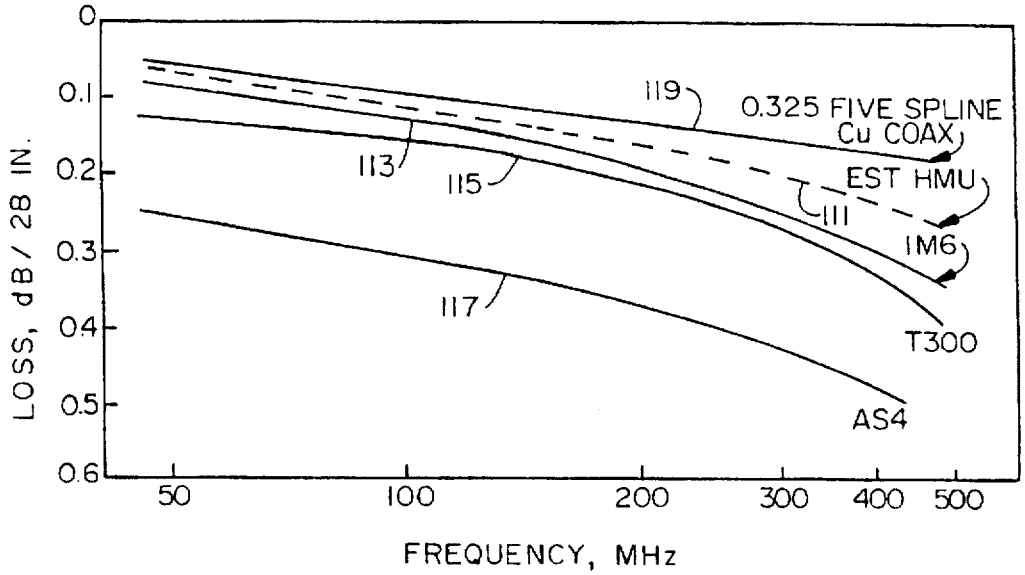
FIG. 3 is a graph illustrating the variation in conductivity of coaxial cables fabricated according to the preferred embodiment with various graphite/epoxy materials.

FIG. 3 illustrates the conductivity of various graphite epoxy materials wrapped at an angle θ of 15-degrees. The materials are nickel plated HMU, manufactured by Hercules Aerospace Company, Magna, Utah, line 111 (estimated); IM6, as manufactured by Hercules, line 113; T300 as manufactured by Amoco Performance Products, Inc., Concord, Calif., line 115; and, finally, the AS4 material, line 117. The conductivity of these materials is again referenced against that of a five spline copper coax, line 119. FIG. 3 indicates that, the higher the values of Young's Modulus, the greater the RF conductivity. Numerous manufacturers supply graphite fibers. Their desirability as an RF conductor is therefore expected to be directly proportional to their Young's Modulus.

While FIG. 3 shows that HMU has a much lower loss than AS4, HMU has a much higher Young's Modulus, thus making it more brittle and more difficult to form into a desired shape. These tradeoffs should be taken into consideration in any particular application.

An assembly configured according to the preferred embodiment has been measured for insertion loss and VSWR from 20 to 1500 Hz and compared with 0.325-inch (0.827 cm) splined cable with a copper outer conductor. The results confirmed the hypothesis that graphite fibers could be utilized as RF radiators over the frequency spectrum of interest.

It has been found that it is difficult to plate silver or copper on bare graphite fibers. Such plating resulted in a very poor interface bond, which was unacceptable in the application considered. However, as noted above, graphite fibers are available which are plated with nickel (approximately 0.5 microns thick). While nickel is not considered to be the optimum electrical conductor, it permits strong attachment of additional plating, which facilitates electrical connection to structures fabricated according to the preferred embodiment, as will be discussed below. Nickel was found to be an acceptable conductor for dc to low frequencies because the "skin depth" of these frequencies is great enough to prevent adverse results due to nickel's relatively poor conductive characteristics. However, care should be exercised at wavelengths on the order of a millimeter, where "skin depth" is very shallow. The nickel could then become very lossy.

It has been found that the tubular conductor 11 is highly conductive when the surface graphite fibers conduct the RF energy. To obtain contact with the surface fibers, the surface epoxy is bead blasted away from them in a selected area 13 to expose undisturbed, nickel plated graphite fibers 14. It is sufficient to expose the first layer of fibers 14.

Electrical contact to the exposed nickel plated fibers 14 is then established by plating the area 13 with a conductor such as silver or copper. A conductor is then connected to the silver, copper or other plating to electrically join the tube 11 to another conductor, such as another tube 11 or a feed cable.

A method for removing the epoxy to permit plating of the nickel-plated graphite fibers is required. Grit blasting using 50 μm (micrometer) aluminum oxide grit in a microblaster has proved to be a workable approach to remove the epoxy from about the first layer of nickel plated graphite fibers. Grit blasting is easily controlled, was found to not damage the nickel plating or graphite fibers 14, and removes epoxy from between the nickel-plated fibers 14, exposing a large surface area to be subsequently plated.

Other epoxy removal methods proved undesirable. An acid etch approach wicked up the fibers 14, resulted in tube contamination, and greatly reduced the physical properties of the tube 11. Hand sanding was extremely difficult to control and resulted in surface fiber destruction. A plasma etch process proved to be inadequate as it could not etch enough material away—especially between the surface fibers. High pressure (70 lb/in.$^2$ air, 4.93 kg/cm$^2$) bead blasting cleaned the epoxy away, but also damaged the surface fibers. Low pressure bead blasting with a small nozzle would probably be adequate but was not attempted.

Silver plating over the nickel-plated exposed fibers 14 has resulted in maximum bond strength. Pull testing at 90 degrees has resulted in peel strengths from 40 to 60 lb/in. (10.72 kg/cm) (three to four times that required for a printed circuit board). When failure occurs, the first layer of graphite fibers is delaminated away from the adjacent underlying fibers. Excellent solder characteristics are also obtained. Typical solder joints have been successfully temperature cycled 4000 times over the range of ±200° F. (93.3° C.) without failure of the solder or the plating bond.

Figure 4:
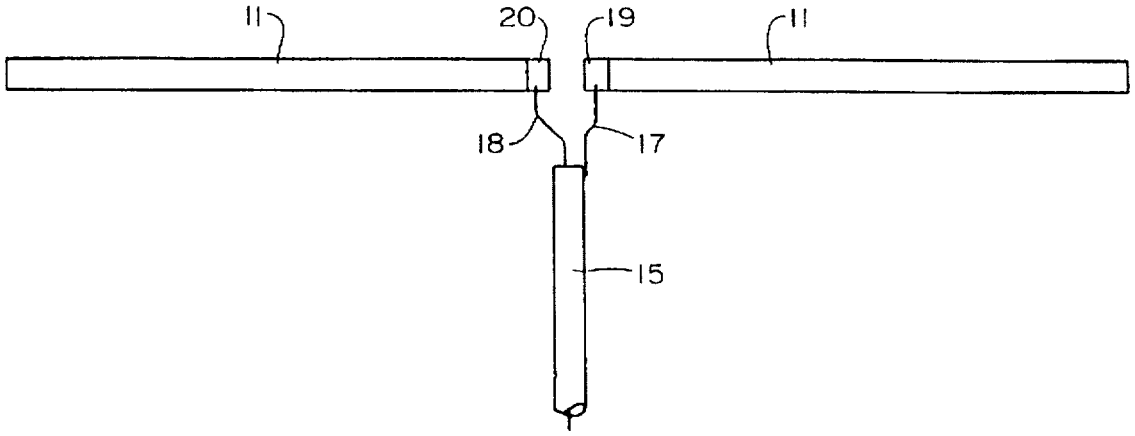
FIG. 4 is a schematic view of a simple dipole employing conductors formed in accordance with a preferred embodiment.

FIG. 4 illustrates a simple dipole antenna structure configured from first and second tubes 11 and a coaxial feed 15. Leads 17, 18 are soldered to silver plated areas 19, 20 of the tubes 11. A coaxial cable may also be made out of the graphite epoxy material with losses similar to those shown in FIGS. 2 and 3.

Figure 5:
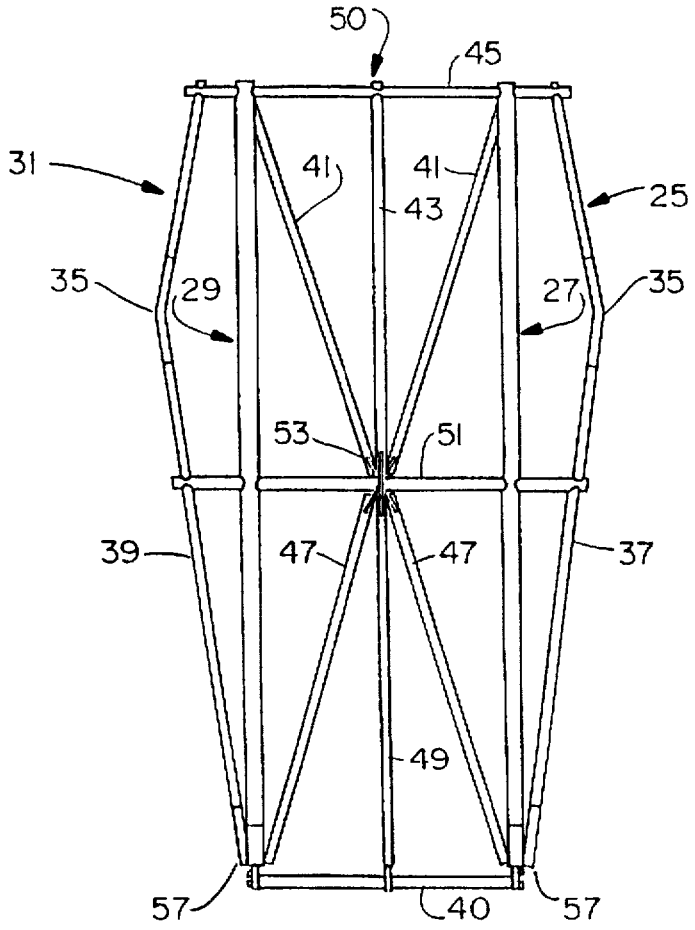
FIG. 5 is a schematic diagram of one-half of a dipole antenna employing four cross-dipoles fabricated from tubular conductors in accordance with the preferred embodiment.

The tubular conductors 11 of the preferred embodiment have also been used to design an ultra-lightweight dipole assembly in the 15- to 75-MHz range. One-half of such a dipole is shown in FIG. 5, the other half being the mirror image of the half shown. The structure of FIG. 5 was designed and constructed as an electrically flat panel to obtain a bandwidth of at least one octave (30 to 75 MHz). The entire antenna (half dipole shown and its mirror image) is consequently about 18×90 inches (45.72×228 cm).

The graphite/epoxy tubes 25, 27, 29, 31, 37, 39, 40 of FIG. 5 are held in place by a truss structure 50. This structure 50 includes truss tubes 41, 43, 47, 49 extending from a central truss fitting 53. The central truss fitting 53 is mounted on a central truss tube 51 through which each of the dipole elements 27, 29, 37, 39 pass. The outer truss tubes 41, 43 fit together with a tip tube 45, while the inner truss tubes 47 are joined with the graphite/epoxy tubes 29, 27, 37, 39 at outer fittings 57. Each upper outer graphite/epoxy tube 25, 31 is shown joined to a respective lower tube 37, 39 by respective elbows 35. The elbows 35 are graphite epoxy tubes of a slightly wider diameter than the tubes 31, 37; 25, 39 to facilitate joinder. The joints between the elbows 35 and tubes 31, 37, 25, 39 employ copper conductors to electrically join the graphite/epoxy tubes according to the attachment method described in connection with FIG. 1. The tubes 27, 29, 37, 39 are electrically joined to the lower cross tube 40 in the same manner. The mirror image half dipole (not shown) may be made pivotable about the tube 40 if desired.

With the antenna structure of FIG. 5, one may achieve a natural and resonant frequency exceeding 50 Hz, a high Young's Modulus, on the order of $16\times10^{16}$ pounds per square inch (1.11 kg/cm$^2$), and an allowable weight budget of 0.5 pounds (0.227 kg) per dipole. This provides a much lighter but stronger structure than heretofore available.

Ion vapor deposited aluminum on all radiating surfaces over unplated fiber graphite tubes was considered for achieving RF conductivity for the structure of FIG. 5. However, the weight added necessitated the use of considerably larger tubes which resulted in approximate doubling of the allowable weight.

An additional application of the preferred embodiment is in the fabrication of the leading edge of an aircraft wing. In such an application a graphite epoxy dipole is disposed along the leading edge of the wing within another material such as Fiberglass™ or Kevlar™. In addition to functioning as an antenna, the graphite epoxy has sufficient resistance to serve as a deicing element for the wing, and the strength to withstand the lift forces to which the leading edge of the wing is subjected. The invention may also be used for lightning protection of composite aircraft.

In conclusion, graphite fibers in an epoxy matrix perform well as an RF radiator. RF components such as spacecraft antennas, horns, phased arrays, and transmission lines are potential applications in addition to those discussed herein.

From the foregoing disclosure of the preferred embodiments, various modifications, configurations and adaptations of the disclosed graphite/epoxy structures will be apparent to one skilled in the art. Therefore, it is to be understood that, within the scope of the appended claims, the invention may be practiced other than as specifically described herein.

What is claimed is:

1. A method of forming an electrical conductor comprising the steps of forming elongated graphite fibers into a conductive hollow structure having an outer surface, wherein said fibers are oriented in a selected manner;

applying a binding material to said conductive structure to embed said graphite fibers therein;

removing a portion of the binding material at the outer surface of the hollow structure while leaving a portion of the graphite fibers embedded in said binding material undisturbed; and establishing an electrical contact to the graphite fibers in the area of the outer surface of the hollow structure where said portion of binding material has been removed.

2. The method of claim 1 wherein said step of forming includes the step of aligning said graphite fibers in the desired direction of radio frequency current propagation.

3. The method of claim 1 wherein said graphite fibers are nickel plated.

4. The method of claim 3 wherein the step of establishing an electrical contact comprises silver plating.

5. A method of forming an electrical conductor comprising the steps of forming elongated graphite fibers into a conductive structure wherein said fibers are oriented in a selected manner;

applying a binding material to said conductive structure to embed said graphite fibers therein;

removing a portion of the binding material while leaving a portion of the graphite fibers embedded in said binding material undisturbed, wherein said step of removing comprises bead blasting said portion of the binding material; and establishing an electrical contact to the graphite fibers in the area where said portion of binding material has been removed.

6. The method of claim 5 wherein said binding material is epoxy.

7. A method of forming an electrically conductive structure comprising the steps of:

wrapping a graphite/epoxy tape about a forming structure at a selected wrap angle;

bead blasting away a portion of the epoxy to leave an undisturbed layer of exposed graphite fibers; and establishing electrical contact to said exposed graphite fibers.

8. The method of claim 7 wherein said selected wrap angle is chosen such that said graphite fibers are aligned in the desired direction of radio frequency current propagation through said conductor.

9. A method of forming an electrical conductor comprising the steps of preparing an antenna structure comprising:

a hollow tube formed of graphite fibers embedded in a binding material, the hollow tube having an inner surface and an outer lateral surface, a center electrical conductor lying within an interior of the hollow tube, and a dielectric support that supports the center electrical conductor from the inner surface of the hollow tube;

removing a portion of the binding material at the outer lateral surface of the hollow tube while leaving a portion of the graphite fibers embedded in said binding material undisturbed; and establishing an electrical contact to the graphite fibers in the area of the outer lateral surface of the hollow tube where said portion of binding material has been removed.

10. The method of claim 9, wherein the graphite fibers are nickel plated.

11. The method of claim 9, wherein the binding material is epoxy.

12. The method of claim 9, wherein the step of forming includes the step of aligning the graphite fibers in the desired direction of radio frequency current propagation.

13. The method of claim 9, wherein the step of removing comprises bead blasting the portion of the binding material.

14. The method of claim 9, wherein the step of establishing includes the step of plating an electrically conductive layer onto the graphite fibers.

15. The method of claim 14, wherein the step of establishing includes the step of soldering an electrical conductor to the plated electrically conductive layer.

16. The method of claim 14, wherein the graphite fibers are nickel plated.

* * * * *